US010311792B2

(12) United States Patent
Scheibe

(10) Patent No.: US 10,311,792 B2
(45) Date of Patent: Jun. 4, 2019

(54) EXPANDED GAMUT ELECTROLUMINESCENT DISPLAYS AND METHODS

(71) Applicant: Landmark Screens, LLC, Palo Alto, CA (US)

(72) Inventor: Paul O. Scheibe, Arroyo Grande, CA (US)

(73) Assignee: Landmark Screens, LLC, Palo Alto, CA (US)

( * ) Notice: Subject to any disclaimer, the term of this patent is extended or adjusted under 35 U.S.C. 154(b) by 37 days.

(21) Appl. No.: 15/221,466

(22) Filed: Jul. 27, 2016

(65) Prior Publication Data

US 2018/0033369 A1 Feb. 1, 2018

(51) Int. Cl.

| | |
|---|---|
| ***G09G 3/3258*** | (2016.01) |
| ***G09G 3/20*** | (2006.01) |
| ***G09G 3/3233*** | (2016.01) |
| *G09G 3/3208* | (2016.01) |

(52) U.S. Cl.

CPC ..... *G09G 3/3258* (2013.01); *G09G 3/2003* (2013.01); *G09G 3/3233* (2013.01); *G09G 3/3208* (2013.01); *G09G 2300/0452* (2013.01); *G09G 2320/0666* (2013.01); *G09G 2340/06* (2013.01)

(58) Field of Classification Search

CPC ... G09G 3/3258; G09G 3/2003; G09G 3/3233
See application file for complete search history.

(56) References Cited

U.S. PATENT DOCUMENTS

| | | | | |
|---|---|---|---|---|
| 5,463,702 | A | 10/1995 | Trueblood | |
| 6,204,939 | B1 | 3/2001 | Lin et al. | |
| 6,448,950 | B1 * | 9/2002 | Cheng | G09G 3/30 315/160 |
| 2003/0043088 | A1 * | 3/2003 | Booth, Jr. | G09G 3/3208 345/45 |
| 2006/0262053 | A1 | 11/2006 | Lee et al. | |
| 2008/0204366 | A1 | 8/2008 | Kane et al. | |
| 2009/0040197 | A1 | 2/2009 | Scheibe | |
| 2010/0073338 | A1 * | 3/2010 | Miller | G09G 3/3233 345/205 |
| 2012/0062618 | A1 | 3/2012 | Ono | |
| 2012/0256969 | A1 * | 10/2012 | Scheibe | G09G 3/32 345/690 |

OTHER PUBLICATIONS

PCT/US2017/044218 Search Report and Written Opinion dated Oct. 6, 2017.

* cited by examiner

*Primary Examiner* — Towfiq Elahi
(74) *Attorney, Agent, or Firm* — Edward C. Kwok; VLP Law Group, LLP

(57) ABSTRACT

In a display system having pixels made up of electroluminescent devices (ELDs) of three or more basis colors, a control circuit receives for each pixel a specification of a desired color to be displayed on the pixel, and determines a required driving voltage or electrical current for ELDs of each basis color, the required driving voltage or electrical current being determined from values of driving voltages or electrical currents associated with predetermined colors within the spectral locus or the purple line of human vision.

24 Claims, 8 Drawing Sheets

Unconstrained LED Drive Currents. – Shows contours of maximum available luminous intensity as a function of pixel CIE color coordinates (x, y). The heavy black line encloses the gamut. Contours are at {0.95, 0.85, 0.75,...,0.05} times the maximum available luminous intensity ( Y=11.8 candela).

Unconstrained LED Drive Currents. – Shows contours of maximum available luminous intensity as a function of pixel CIE color coordinates (x, y). The heavy black line encloses the gamut. Contours are at {0.95, 0.85, 0.75,...,0.05} times the maximum available luminous intensity ( $Y$=11.8 candela).

Constrained ELD Drive Currents. – Contours are at {0.95, 0.85, 0.75,...,0.05} times the maximum available luminous intensity ($Y$=5.9 candela, $p$=0.5).

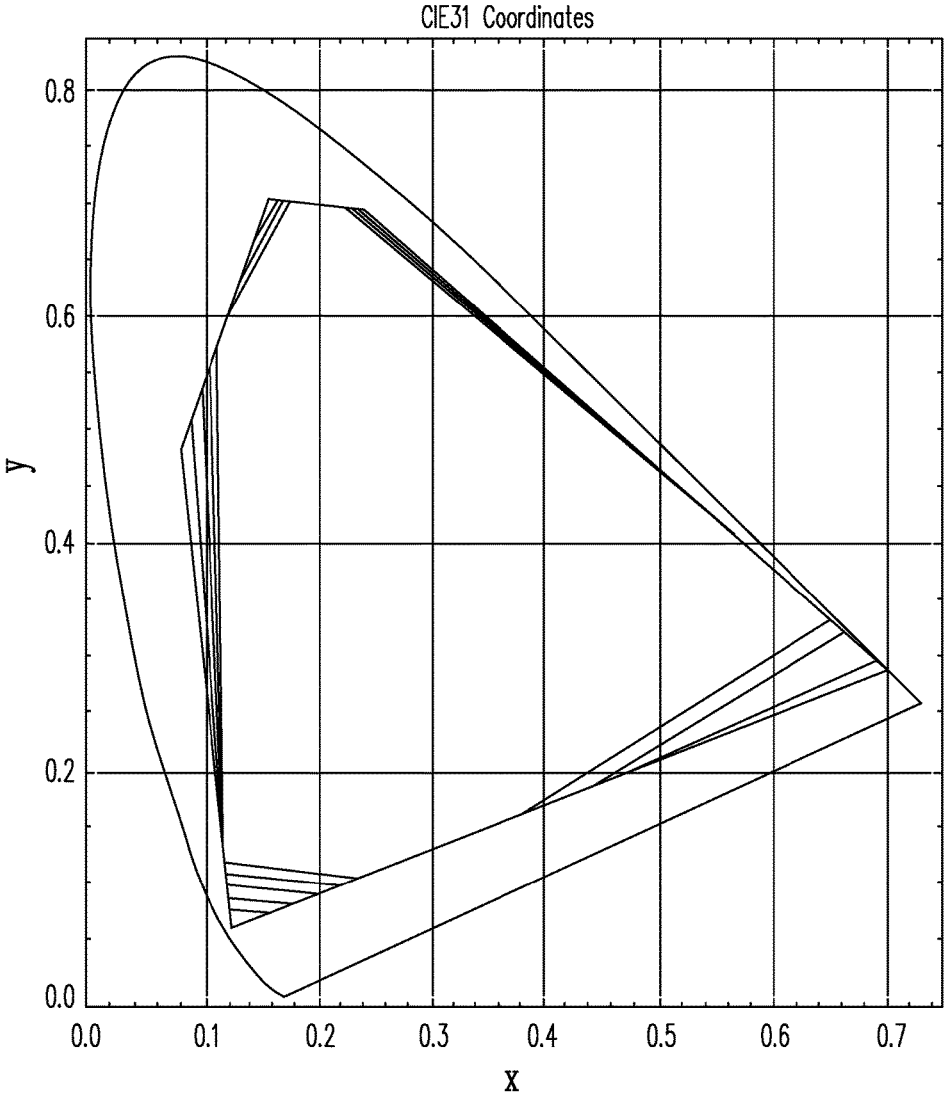

FIG. 8

Constrained ELD Drive Currents. – Contours are at {0.95, 0.85, 0.75,...,0.05} times the maximum available luminous intensity ($Y$ =3.54 candela, $p$ =0.3).

particularly useful when the interpolation function is time-dependent as when tracking ambient light. In such cases, additional constraints in the linear (or non-linear) programming problem are useful to maintain gamut and presentation control.

EXPANDED GAMUT ELECTROLUMINESCENT DISPLAYS AND METHODS

BACKGROUND OF THE INVENTION

1. Field of the Invention

The present invention relates to electroluminescent device-based multi-color display systems ("EL displays"). In particular, the present invention relates to controlling displaying of any specified color on an EL display accurately and efficiently, when the EL display is formed out of display elements of three or more basis colors, with each basis colors being provided by one or more electroluminescent devices (ELDs).

2. Discussion of the Related Art

Electroluminescence (EL) is the phenomenon by which a electroluminescent material emits light under an applied electric field or the passage of an electric current. Examples of materials exhibiting EL include Group III-V semiconductors, manganese-doped or copper-doped zinc sulfide, and various organic semiconductors. Devices incorporating electroluminescent materials (ELDs) have been used in a variety of consumer and technical products to harness the EL phenomenon for many applications (e.g., in display elements in graphical or video display systems). See, for example, the article "Electroluminescent organic and Quantum Dot LEDs: *The State of the Art*," in the *Journal of Display Technology* 11(5), pp. 480-493 (2015). Light from such display elements typically has three or less basis colors (constituting the basis colors) available to synthesize distinct colors and luminance in the visible spectrum. U.S. Pat. No. 8,618,559 ("Hamaguchi"), entitled "Organic Luminescent Display," discloses, for example, a multi-color display having organic EL elements to provide red, green, and blue sub-pixels.

Providing three basis colors (or even less) limits both the gamut and the saturation in each color available to the viewer. Inclusion of additional EL elements having other (e.g., blue-green and green-yellow) basis colors would allow expansion of the gamut of the light available from the display. When more than three basis colors are used, a desired color at a specified luminance may be displayed by applying one of several sets of control stimuli on the EL elements. As a result, choosing which combination to use is a technical problem that must be efficiently addressed to achieve an effective control strategy.

SUMMARY

According to one embodiment of the present invention, a display system that includes pixels made up of electroluminescent devices (ELDs) of three or more basis colors, also includes a control circuit that receives for each pixel a specification of a desired color to be displayed by the pixel. For each pixel, the control circuit determines a required driving voltage or electrical current for ELDs of each basis color. In one embodiment, the required driving voltage or electrical current are determined from (a) values of driving voltages or electrical currents associated with predetermined colors within the spectral locus of human vision and (b) interpolating between the values of driving voltages or electrical currents. In the case where the ELDs include more than three basis colors, more than one set of required driving voltages or electrical currents may display the desired color at the pixel. In that case, the control circuit may select the set of required driving voltages or electrical currents based on a power or another desirable consideration.

In one embodiment, the values of driving voltages or electrical currents are determined off-line, using constraints related to physical characteristics of the ELDs, while interpolating between the values of driving voltages or electrical currents is carried out in real time.

According to one embodiment of the present invention, when the desired color is outside of the gamut, the desired color may be mapped to a substitute color within the gamut provided by the ELDs in the display system. In one embodiment, the display system selects the substitute color from colors in the gamut along a line of approximate constant hue connecting an achromatic point to a color on the spectral locus.

According to one embodiment of the present invention, the required driving voltage or electrical current is scaled from values of driving voltages or electrical currents that yield a predetermined luminous intensity of the desired color.

According to one embodiment of the present invention, the predetermined colors within the spectral locus are sampled in a uniform color space based on a predetermined spacing between adjacent ones of the predetermined colors. Such predetermined spacing may be related to an Euclidean distance calculated in a uniform color space, for example.

The present invention is better understood upon consideration of the detailed description below in conjunction with the accompanying drawings.

BRIEF DESCRIPTION OF THE DRAWINGS

FIG. 2 shows that 99.85% of the samples have an error $\Delta E^* \leq 1.0$.

FIG. 2 shows all 15 of the 10,000 samples that have an error $\Delta E^* > 1.0$.

FIG. 8 shows contours of maximum available luminous intensity as a function of CIE color coordinates and 0.3 times the allowable maximum luminous intensity (i.e., $\rho=0.3$).

DETAILED DESCRIPTION OF THE PREFERRED EMBODIMENTS

A multi-color EL display typically allows control of each EL element of each pixel (i.e., each basis color) independently. The luminance response of the control mechanism is typically a linear function of the input stimulus. For example, the luminance of a green basis color of each pixel in the EL display may be made directly proportional to the applied control stimulus (e.g., voltage, current, or charge). The control stimulus may be applied directly, or indirectly. An example of indirect application may be, for example, a command or message sent between modules of an EL display, or within a module of an EL display.

Suppose that, in one pixel of a multi-color EL display, the desired primary color stimuli in the CIE XYZ (tristimulus) colorimetric system are X, Y and Z. The basic colorimetric equations for the linear or additive color mixture are:

$$\sum_{p=1}^{P} b_p X_p = X \tag{1a}$$

$$\sum_{p=1}^{P} b_p Y_p = Y \tag{1b}$$

$$\sum_{p=1}^{P} b_p Z_p = Z \tag{1c}$$

for a pixel containing P different basis colors (i.e., P different EL subpixels, each subpixel being implemented by one or more ELDs of the corresponding basis color), where the p-th basis color is specified by CIE XYZ coordinates ($X_p$, $Y_p$, $Z_p$) at its maximum luminous intensity. Equations (1a) to (1c) indicates that the desired color (X, Y, Z) may be reproduced by driving the P ELDs by drive $b_p$, provided that $0 \le b_p \le 1$, for p=1, . . . , P.

Equations (1a) to (1d) may be represented by a vector-matrix form (i.e., bold lower-case letters represent vectors) as:

$$Ab = v \tag{2a}$$

where $$A = \begin{bmatrix} X_1 \ldots X_p \ldots X_P \\ Y_1 \ldots Y_p \ldots Y_P \\ Z_1 \ldots Z_p \ldots Z_P \end{bmatrix} \tag{2b}$$

$$b = \begin{bmatrix} b_1 \\ \ldots \\ b_p \\ \ldots \\ b_P \end{bmatrix} \tag{2c}$$

$$v = \begin{bmatrix} X \\ Y \\ Z \end{bmatrix} \tag{2d}$$

(Vectors b and v are referred to as the "control vector" and the "desired color vector", respectively).

In many instances, rather than using the XYZ (tristimulus) coordinates, the chromaticity coordinates (x, y, z) may be used. Transformation from the tristimulus coordinates and chromaticity coordinates may be achieved by:

$$x = \frac{X}{X+Y+Z} \tag{3a}$$

$$y = \frac{Y}{X+Y+Z} \tag{3b}$$

-continued $$z = \frac{Z}{X+Y+Z} \tag{3c}$$

Note that x+y+z=1. Typically the pair (x, y) taken from the chromaticity coordinates (x, y, z) representation may be used to specify the color and, when needed, coordinate z may be calculated by z=1−x−y.

The luminous intensity is given by Y, under the CIE XYZ (tristimulus) system. The tristimulus coordinates may be recovered from the chromaticity coordinates and Y, according to:

$$X = \frac{x}{y} Y \tag{4a}$$

$$Y = \frac{y}{y} Y = Y \tag{4b}$$

$$Z = \frac{z}{y} Y = \frac{1-x-y}{y} Y \tag{4c}$$

In matrix form, from equations (4a)-(4c), desired color vector v may be written as:

$$v = \frac{Y}{y}\begin{bmatrix} x \\ y \\ z \end{bmatrix} = \frac{Y}{y}\begin{bmatrix} x \\ y \\ 1-x-y \end{bmatrix}$$

Figure 1:
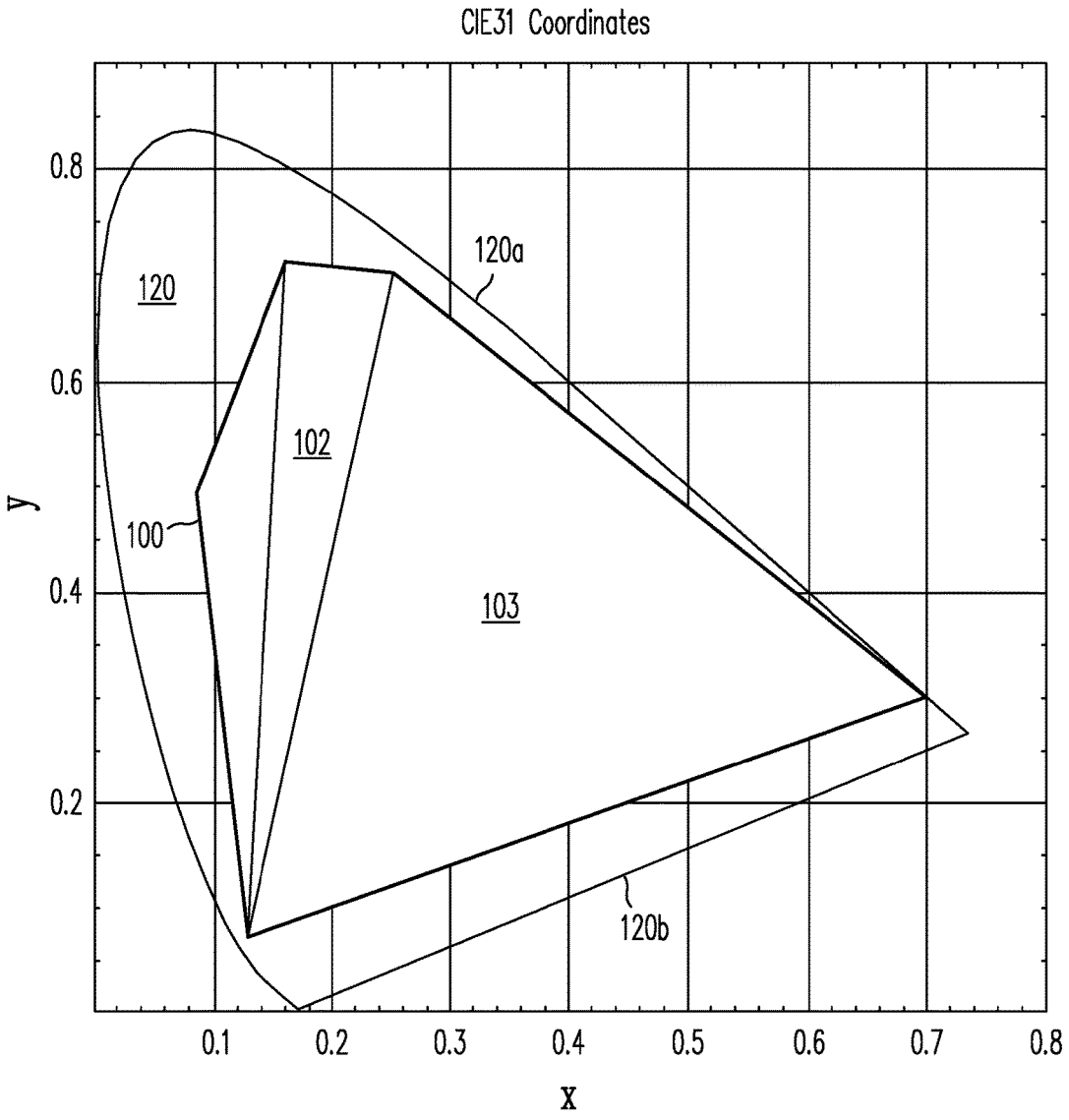
FIG. 1 shows an example gamut 100 using five basis colors.

At least three basis colors are necessary to provide a useful gamut. Using more than three basis colors can expand the gamut and add redundancy that works around certain failures and introducing degrees of freedom for optimization of performance. FIG. 1 shows an example gamut 100 using five basis colors. FIG. 1 is a plot in the (x, y) plane of CIE (x, y, z) calorimetric system. A discussion of the CIE colorimetric system may be found, for example, *Color Science: Concepts and Methods, Quantitative Data and Formulae*, by Gunter Wyszecki and W. S. Stiles, 2nd Edition. John Wiley & Sons, Inc., New York (1982) (the "Wyszecki text"), esp. pp. 137-142. As shown in FIG. 1, contour 120 represents the boundary of the set of colors that are believed perceptible by humans. Contour 120 includes curved portion 120*a* ("spectral locus"; representing monochromatic colors between blue and red) and straight line portion 120*b* ("purple line"). Gamut 100 is a pentagon having vertices at the CIE (x, y) coordinates of blue (0.13, 0.07), cyan (0.085, 0.490), green (0.16, 0.71), green-yellow (0.25, 0.70) and red (0.70, 0.30). Each of these colors may be seen as basis colors of gamut 100 in the sense that any color within gamut 100 may be produced by a combination of one or more of the basis colors. As shown in FIG. 1, using a resolution of ΔE=1 and a constant luminance at L=60, there are about 40200 colors in the pentagon, with about 3700 colors within triangle 101, 4000 in triangle 102 and 32500 in triangle 103. (In this example, ΔE is the corresponding Euclidean distance or metric calculated between colors under the CIE (L*, a*, b*) colorimetric system, defined by $\Delta E=\sqrt{\Delta a^2+\Delta b^2+\Delta L^2}$, where L is a normalized value between 0 and 100: ΔE=1 represents a color difference that is slightly below human perception).

With three basis colors the required drive in a pixel implemented by ELD devices ("ELD drive") to produce a given color and luminous intensity is usually unique (i.e., only one choice is available). When more than three basis colors are used in the pixel, the ELD drive is generally not unique and it is possible to impose further conditions on the ELD drive that are advantageous. Because of the non-uniqueness, there are many possible approaches to calculate such ELD drives.

Given basis specification matrix A and the desired chromaticity coordinates (x, y), the maximum possible luminous intensity $\hat{Y}$ and its associated control vector $\hat{b}$ from equation (2a), control vector $\hat{b}$ may be scaled to obtain any other choice of luminous intensity Y for the pixel of a multi-color EL display that has a linear control mechanism. Furthermore, when (x, y) of the desired color are within the gamut provided by the P basis colors in the EL subpixels of the multi-color EL display, all elements of $b_i$ of control vector $\hat{b}$ are non-negative and do not exceed unity (i.e., $0 \le b_p \le 1$, for p=1, . . . , P). Otherwise, the desired pixel color is not possible and a substitute color that approximates the desired color may need to be used.

According to one embodiment of the present invention, one approach assures that the maximum luminous intensity can be attained for any color in the gamut of colors. The first step finds the ELD drive vector $\hat{b}$ required to produce the maximum luminous intensity $\hat{Y}$ for each color in selected set of colors within the gamut of colors. These selected set of colors may then be used in an interpolating function $f(x, y)$ to calculate the ELD drive vector $\hat{b}$ of the desired color. As discussed above, the control vector $\hat{b}$ for any given color may be calculated from the quantity and specification of the ELDs in a pixel. These calculations may be performed "off-line" (i.e., in advance of real-time display operations). In the second step, e.g., when display of a desired color (x, y, Y) is required, the interpolating function $f(x, y)$, together with the previously calculated ELD drive vectors $\hat{b}$ and the (x, y) colorimetric coordinates) are used to determine the maximum possible luminous intensity $\hat{Y}$ for the desired color and the corresponding required ELD drive vector $\hat{b}$. If the maximum possible luminous intensity $\hat{Y}$ exceeds the desired pixel luminous intensity Y, the required ELD drive vector to reproduce the desired color at luminous intensity Y (i.e., the "desired drive vector") may be obtained by scaling ELD drive vector $\hat{b}$ required to achieve the maximum possible luminous intensity $\hat{Y}$ (i.e., the desired drive vector is given by $$\frac{Y}{\hat{Y}}\hat{b}.$$

This second step requires merely a small number of multiplications, which may be performed in real-time in the ELD display.

Thus, a desired color specified by chromatic coordinates (x, y) and having a maximum luminosity intensity Y is realizable within the gamut represented by basis color specification matrix A, when two constraints ($C_1(Y)$ and $C_2$) are satisfied.

$$C_1(Y) \quad Ab = \frac{Y}{y}\begin{bmatrix} x \\ y \\ 1-x-y \end{bmatrix} \tag{5(a)}$$

-continued $$C_2 \quad 0 \le b \le 1 \tag{5(b)}$$

Constraint $C_1(Y)$ ensures that the desired color is within the gamut specified by basis specification matrix A, while constraint $C_2$ ensures that all elements of control vector b for the ELDs in the subpixels (i.e., basis colors) are non-negative and do not exceed unity, the value needed to produce maximum luminosity for each of the basis colors. The maximum possible luminous intensity $\hat{Y}$ at the desired color coordinates (x, y) and its associated control vector $\hat{b}$ is the solution of the problem:

$$\hat{Y}, \hat{b} = \{Y \ge \hat{Y}, b \mid C_1(Y), C_1(\hat{Y}), C_2\} \tag{5(c)}$$

If (x, y) is not in the gamut represented by basis specification matrix A, the solution to problem 5(c) is b=0 and $\hat{Y}$=0.

Problem 5(c) may be reduced to a standard linear programming problem by solving for Y in one of the rows of equations 5(a) (e.g., the y row), substituting the solution Y in the other two rows of equations 5(a) and grouping the results. That is, denoting the i-th row of basis specification matrix A by $A_i$, equations 5(a) may be written as:

$$\begin{aligned} A_2 b &= Y \\ A_1 b &= \left(\frac{x}{y}\right)Y \\ A_3 b &= \left(\frac{1-x-y}{y}\right)Y \end{aligned} \tag{6(a)}$$

which may be rewritten by substituting the $A_2b$ for Y in the second and third of equations 6(a) and rearranging to obtain:

$$\begin{aligned} A_2 b &= Y \\ \left(A_1 - \left(\frac{x}{y}\right)A_2\right)b &= 0 \\ \left(A_3 - \left(\frac{1-x-y}{y}\right)A_2\right)b &= 0 \end{aligned} \tag{6(b)}$$

Then, using equations (6b), problem 5(c) reduces to the linear programming problem of maximizing $A_2$ b subject to the constraints:

$$\begin{aligned} A_2 b &= Y \\ \left(A_1 - \left(\frac{x}{y}\right)A_2\right)b &= 0 \\ \left(A_3 - \left(\frac{1-x-y}{y}\right)A_2\right)b &= 0 \\ 0 \le b &\le 1 \end{aligned} \tag{7(a)}$$

yielding the control vector $\hat{b}$ that provides the maximum possible luminous intensity $\hat{Y}$. Maximizing $A_2b$ provides the maximum luminous intensity; other choices of objective functions may be chosen to yield other desiderata. For example, one may consider control vectors that do not necessary yield the maximum possible luminous intensity $\hat{Y}$. One may also want to control based on (i) limits on thermal dissipation in the ELD drivers; (ii) luminous intensity dynamic range shaping; (iii) linear or non-linear control of smoothness of control vector transitions; and (iv) additional bounds on the output range of driver circuits. While such solutions may not necessarily achieve the maximum possible luminous intensity, each such solutions may be used at different times according to a rotation scheme. For look-up tables implemented in certain types of non-volatile memory devices, such as flash memories, rotating the various solutions is desirable to meet endurance constraints in such memory devices.

Figure 6:
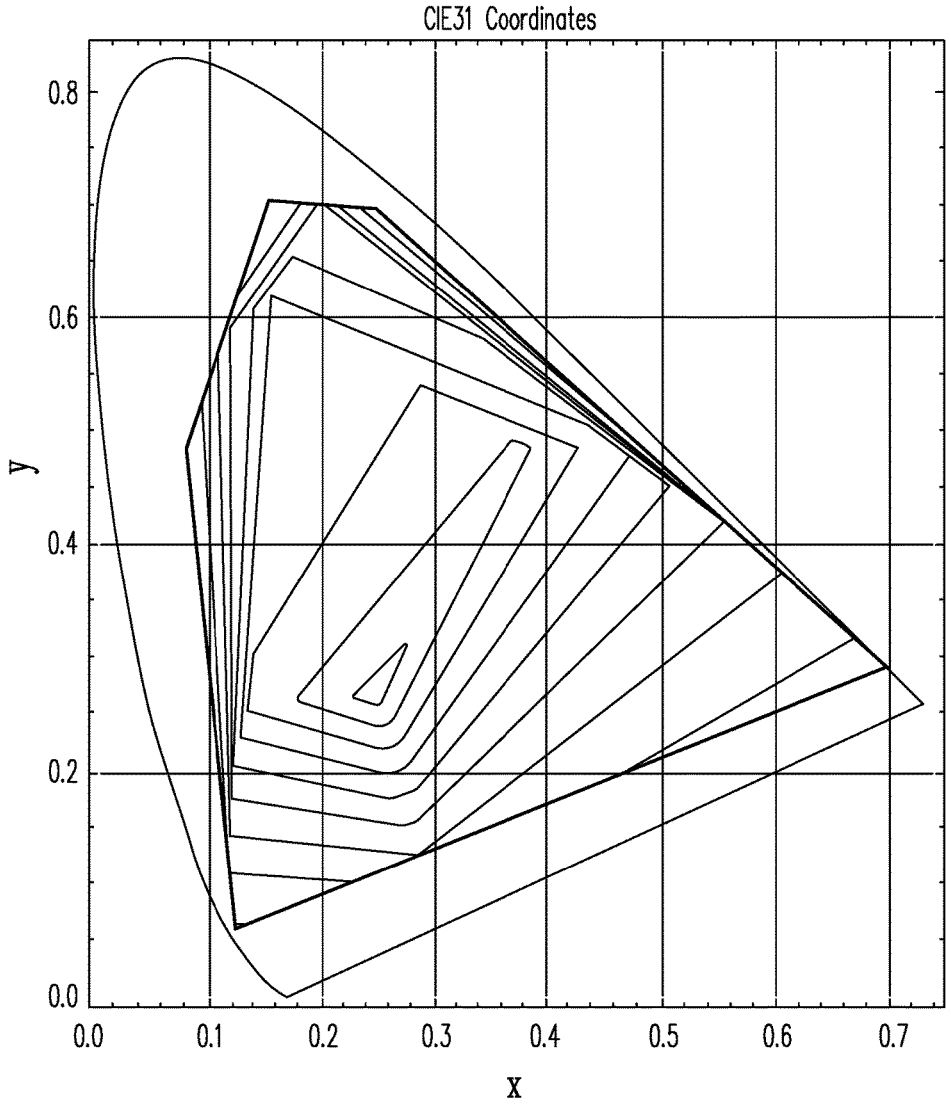
FIG. 6 shows contours of maximum available luminous intensity as a function of CIE color coordinates and the allowable maximum luminous intensity (i.e., $\rho=1.0$).
Figure 7:
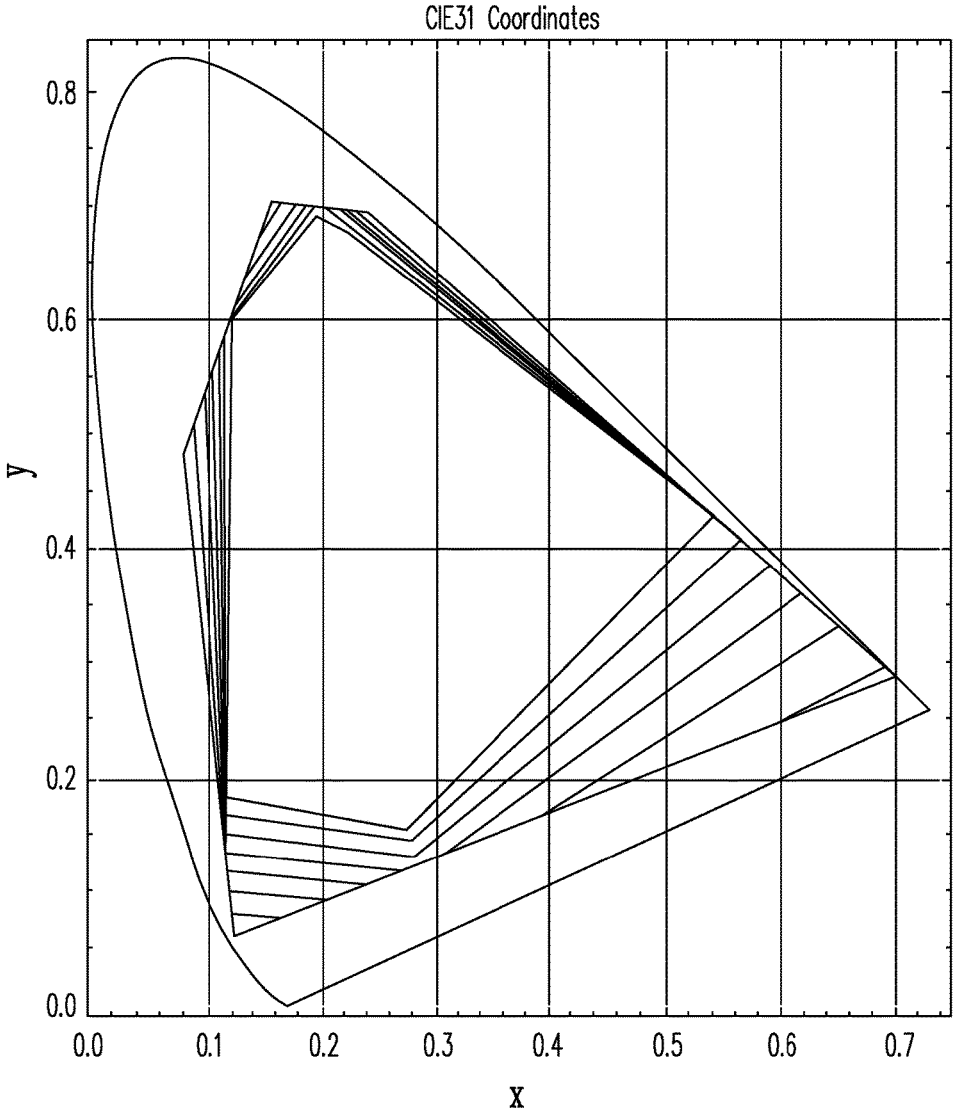
FIG. 7 shows contours of maximum available luminous intensity as a function of CIE color coordinates and 0.5 times the allowable maximum luminous intensity (i.e., $\rho=0.5$).

In one embodiment, an additional constraint that limits the variation in the maximum available luminous intensity over the useful gamut may be achieved by adding the following constraints to Equation 7(a):

$$C_3\colon A_2 b \le \rho \sum_{i=1}^{P} A_{2i}$$

where ρ is a tunable real number parameter, $0<\rho\le 1$, and $A_{2i}$ is the i-th element of the second row of matrix A. This constraint provides an upper bound on the luminous intensity available by flattening the gamut. Specifically, when ρ=1, there is, effectively, no constraint because $A_2$ b=Y controls (as $Y=\Sigma_{i=1}^{P} A_{2i}$). As ρ is decreased, the maximum luminous intensity over the gamut is decreased, resulting in less variation in available luminous intensity. FIGS. 6-8 shows contours of maximum available luminous intensity as a function of CIE color coordinates and allowable maximum luminous intensity (i.e., ρ=1.0, 0.5 and 0.3, respectively). For the system characterized by matrix A, the allowable maximum luminous intensity is 11.8 candela. As can be seen from FIGS. 6-8, maximum luminous intensity is possible for a larger quantity of highly saturated colors as ρ becomes smaller.

The solution of the linear programming problem of maximizing $A_2$ b subject to constraints 7(a) need not be found in real-time and may be solved off-line, as the possible values of the chromaticity coordinates are in a compact set (i.e., the gamut). The compact set property allows, using samples within the set, construction of an interpolator which allows all other values within the gamut to be calculated with arbitrary accuracy. Determining off-line the solutions for the samples within the gamut constitutes the first step of displaying any desired color on an EL display discussed above. The off-line solutions for the samples allow the solution for the desired color to be interpolated in real time in the second step, as discussed above.

For a desired color that is not part of the gamut, a substitute color of the same hue within the gamut may be advantageously obtained. As discussed in the Wyzecki text, at pp. 168-169, colors of approximately constant hue are provided by lines of constant chromaticity ratio in a uniform color space. For example, in the CIE L*a*b* uniform color space, the locus of points having the constant ratio $$\frac{b^*}{a^*}$$

is a line of constant hue. These lines of constant hue are seen emanating from an achromatic or white point (e.g., D65 at $(x_n, y_n)=(0.3127, 0.3290)$) and extend to the spectral locus or the purple line. Similarly, in the in the CIE L*u*v* uniform color space, the locus of points having the constant ratio $$\frac{v^*}{u^*}$$

is a line of constant hue. In a uniform color space, e.g., CIE L*u*v*, the lines of constant hue are straight lines in the (x, y) plane. Therefore, according to one embodiment of the present invention, for a desired color (x, y) not in the gamut, a suitable substitute color may be the point (x', y') on the boundary of the gamut that intersects the line of constant hue connecting (x, y) with the achromatic point. Intersection point (x', y') approximates the desired color at (x, y), and represents the closest point that retains the same hue in the CIE L*u*v* uniform color space.

According to one embodiment of the present invention, the following algorithm implements a first step of determining a drive vector for a desired color (x, y), or its substitute color (x', y'), to be displayed on an EL display. The substitute color is the result of the approximation discussed above that provides the nearest color of the same hue in a CIE uniform color space. This first step is preferably performed off-line, with the results stored in a look-up table, for example, to allow easy access:

Step a: Given basis color specification matrix A and achromatic point $(x_n, y_n)$, selecting a set of colors (x, y) on a grid that covers at least the area bounded by the spectral locus and purple line in the chromatic coordinates (x, y) plane;

Step b: for each selected color (x, y) on the grid:

(i), when color (x, y) is not in the gamut, determining substitute color (x', y'), preferably color (x', y') on the boundary of the gamut that intersects the line of constant hue connecting (x, y) with the achromatic point; and (ii) solving the linear programming problem maximizing $A_2$ b subject to constraints 7(a) above to obtain maximum luminosity intensity $\hat{Y}$ and corresponding control drive $\hat{b}$ for desired color (x, y) or substitute color (x', y');, Y and Step c: Creating function $f(x, y)$ for interpolating luminosity intensity Y and corresponding control vector b based on maximum luminosity intensity $\hat{Y}$ and corresponding control drive $\hat{b}$.

During real-time display of images on an EL display, interpolating function $f(x, y)$ is used to determine, for each desired color (x, y), luminosity intensity Y and corresponding control vector b for driving the ELDs in the corresponding pixel of the EL display. Suitable interpolation function may include a bilinear interpolation function, which may be computed using very few steps of calculation. Higher order interpolation functions may also be used. When a bilinear interpolation function is used, further simplification may be achieved by sampling from a linear color space. The following algorithm implements a second step of determining a drive vector for the desired color (x, y), or its substitute color (x', y'), to be displayed on an EL display:

Step d: for each pixel (x, y, Y) to be displayed, Y being the desired luminosity intensity for the pixel:

(i) evaluating f (x, y) to obtain its maximum luminosity intensity $\hat{Y}$ and corresponding control drive $\hat{b}$; and (ii) determining drive vector $$b = \min\left(\frac{Y}{\hat{Y}}, 1\right)\hat{b}.$$

This second step requires merely a small number of arithmetic operations per pixel. The accuracy after interpolation depends on the mesh size of the grid used in the first step. Errors become arbitrarily small as the mesh size approaches zero.

Table 1 shows the tristimulus coordinates of basis colors blue, cyan, green, green-yellow and red provided by ELDs of an exemplary EL display device:

TABLE 1

| | CIE Tristimulus Coordinates | | |
|---|---|---|---|
| Color | X | y | Y (cd) |
| Blue | 0.13 | 0.07 | 1.56 |
| Cyan | 0.085 | 0.49 | 2.2 |
| Green | 0.16 | 0.71 | 2.92 |
| Green-Yellow | 0.25 | 0.7 | 2.56 |
| Red | 0.7 | 0.3 | 2.56 |

The basis color specification matrix A may be obtained from Table 1 and equations 4(a)-4(c):

$$A = \begin{bmatrix} 2.89711 & 0.3816 & 0.6580 & 0.9143 & 5.9733 \\ 1.56 & 2.2 & 2.92 & 2.56 & 2.56 \\ 17.8286 & 1.9082 & 0.5346 & 0.1829 & 0 \end{bmatrix} \quad 8(a)$$

In basis color specification matrix A of equation 8(a), the columns correspond in column vector form $$\left(\text{i.e.,} \begin{bmatrix} X \\ Y \\ Z \end{bmatrix}\right)$$

the CIE tristimulus (X, Y, Z) vector for the basis colors blue, cyan, green, green-yellow and red of Table 1, respectively.

Figure 2:
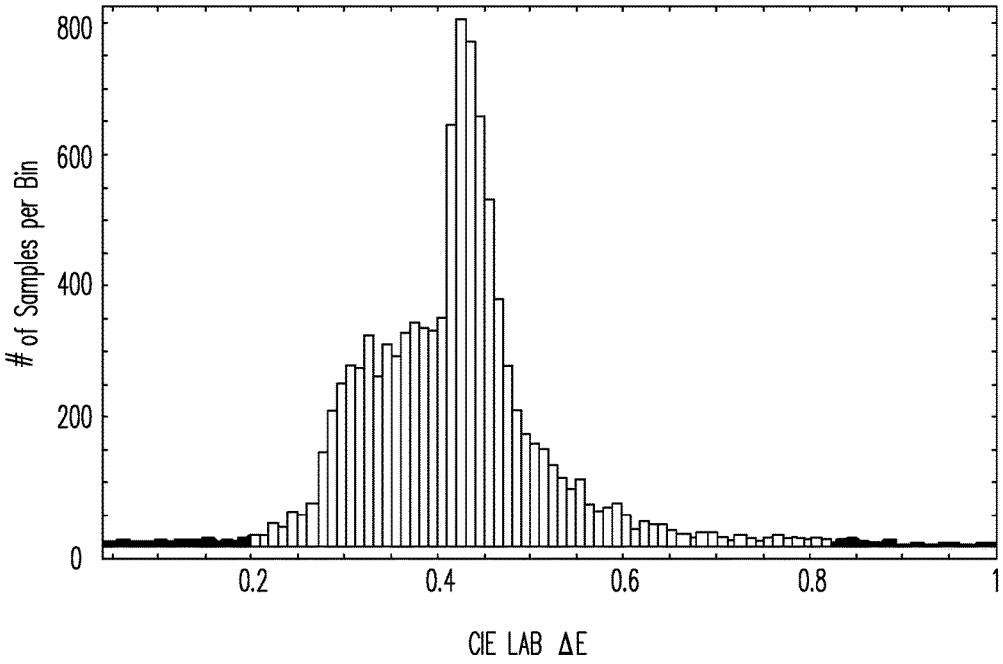
FIG. 2 is a histogram of interpolation errors for the range $\Delta E^* \leq 1.0$, using 10000 samples over a uniformly-spaced grid with spacing of 0.004 unit in both the x–and y– directions.
Figure 3:
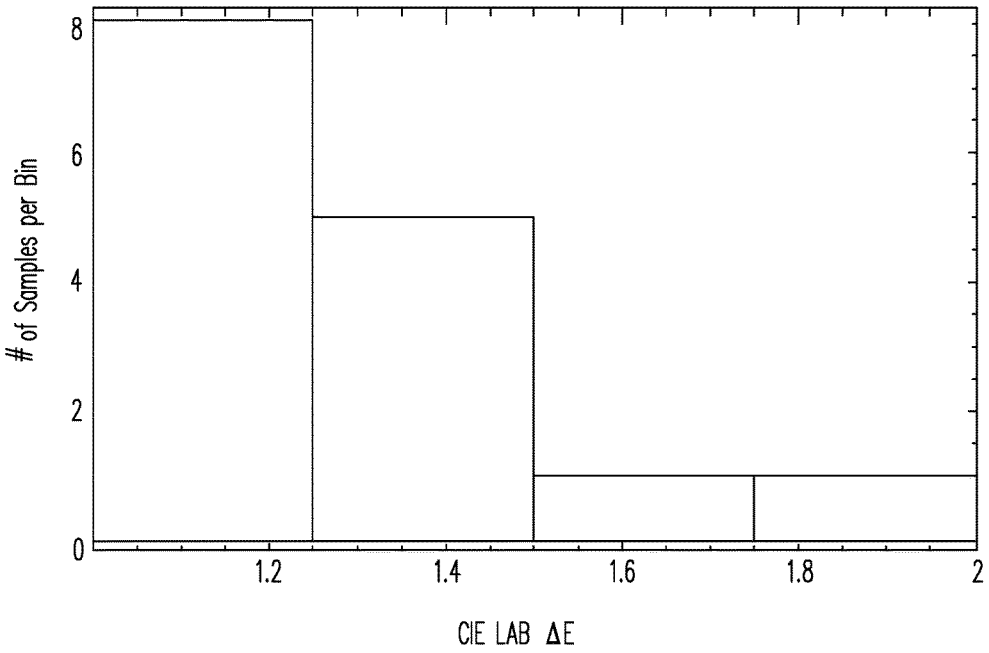
FIG. 3 is FIG. 2's histogram of interpolation errors for the range $1.0 \leq \Delta E^* \leq 2.0$.
Figure 4:
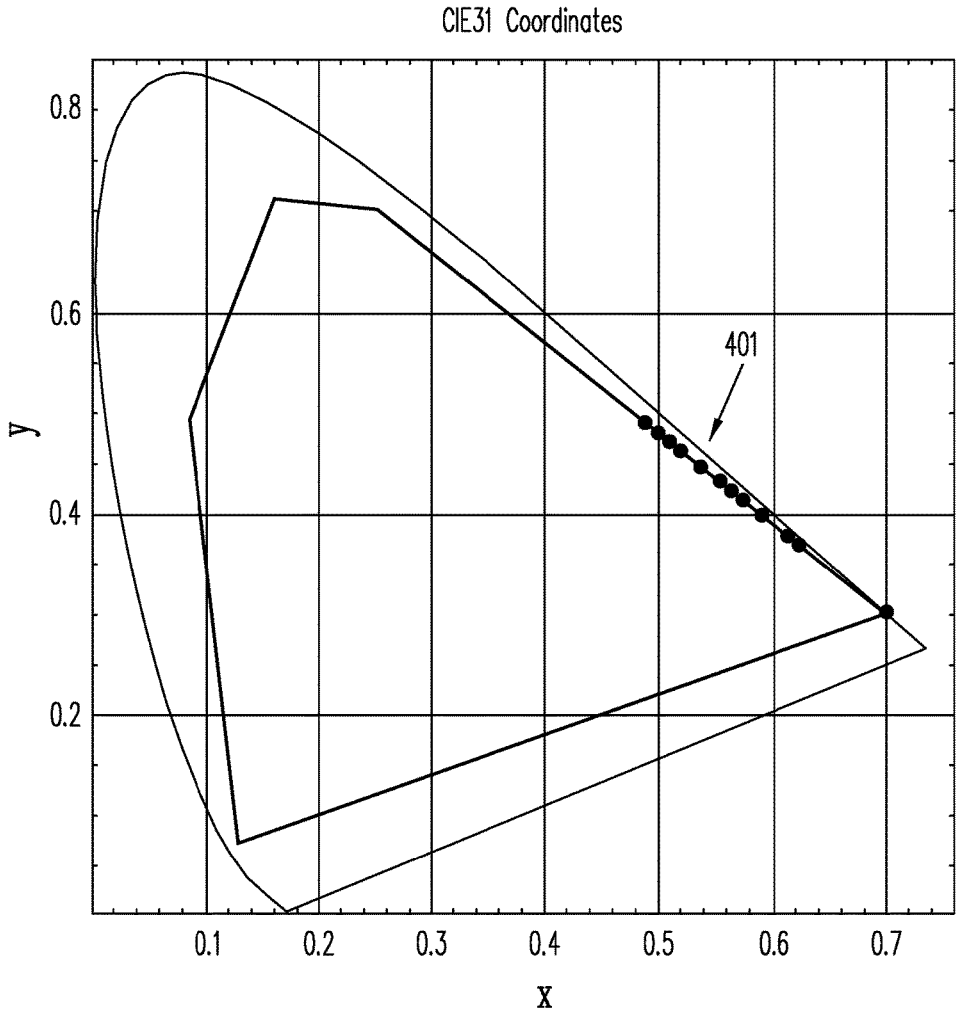
FIG. 4 shows locations 401 in the gamut for the 15 samples of FIG. 3 that have an error $\Delta E^* > 1.0$.

Inherent in any interpolation method is the introduction of errors due to inexact matches of actual and interpolated values, when the interpolated value is not located on a grid point. The inventor has found that uniformly-spaced grid points should have a spacing not larger than about 0.005 units in both the x- and y-directions on the (x, y) plane. The spacing used in the following example illustrated by FIGS. 2 and 3 is 0.004 units in both x- and y-directions. FIG. 2 is a histogram of interpolation errors, showing the distribution of errors for 10,000 uniformly-spaced samples within the area bounded by $0.0 \le x \le 0.8$ and $0.002 \le y \le 0.9$. (Equations 4(a)-4(c) preclude points along y=0.0.) FIG. 2 shows that 9,985 of the 10,000 samples have errors less than $\Delta E^*=1.0$. As shown in FIG. 2, most errors satisfy $\Delta E^*<0.5$; such errors are hardly perceptible in the best of viewing conditions. FIG. 3 shows the distribution of all 15 of the 10,000 samples that have an error $\Delta E^*>1.0$, with the maximum error falling in the range $1.8 \le \Delta E^* \le 2.0$. These distributions are believed typical of the error distribution for samples over a uniformly-spaced grid. Typically, the larger errors are found near the boundary of the gamut. FIG. 4 shows locations 401 in the gamut (indicated by the filled circles) for the 15 samples of FIG. 3 that have an error $\Delta E^*>1.0$. Locations 401 are situated very close to the spectral locus of human vision.

Figure 5:
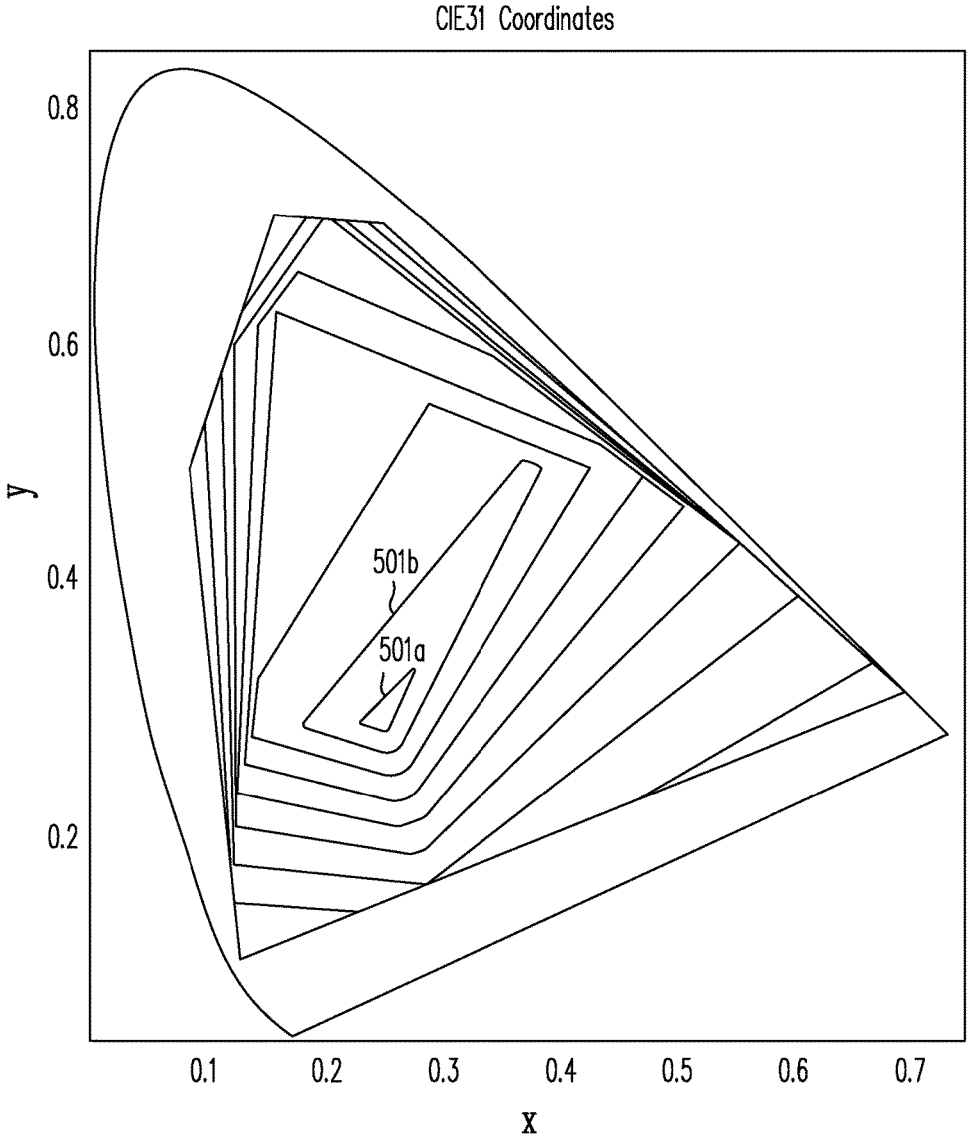
FIG. 5 shows maximal contours of constant luminous intensity 501-*a*, 501-*b* . . . and 501-*n*.

FIG. 5 shows a gray scale representation of the luminous intensity and contours of constant luminous intensity 501-*a*, 501-*b*, . . . , and 501-*n*. Also shown in FIG. 5 is the CIE spectral locus and purple line and the boundary of the gamut represented by basis color specification matrix A of Equation 8(a). Contours 501-*a*, . . . , 501-*n* represent luminous intensities from 0.95*Y, decreasing by 0.05*Y, Y being the maximum luminous intensity value over the entire gamut.

In one embodiment, graphics processing units (GPUs) allow the real-time interpolation evaluations (i.e., steps (i) and (ii) of Step d above) to operate at video rates for a multi-color expanded gamut EL display. Additionally, GPUs facilitate real-time update of the interpolation function $f(x, y)$, as well. This is particularly useful when the interpolation function is time-dependent (e.g., tracking ambient light). In such an application, additional constraints in the linear (or nonlinear) programming problem may be useful to maintain gamut and presentation control (See, e.g., U.S. Pat. No. 8,791,890 and U.S. Patent Application Publication 2009/0040154).

The above detailed description is provided to illustrate specific embodiments of the present invention and is not intended to be limiting. Numerous variations and modifications within the scope of the present invention are possible. The present invention is set forth in the accompanying claims.

I claim:

1. A display system, comprising:

a plurality of pixels each including a plurality of electroluminescent devices (ELDs) of three or more basis colors, the basis colors defining a gamut bounded by the spectral locus and the purple line of human vision, wherein the ELDs of each basis color of each pixel, when driven by a voltage or an electrical current, emit light at a luminosity intensity that corresponds to the driving voltage or electrical current; and a control circuit that, for each of the pixels, (i) receives a specification of a specified color to be displayed on the pixel, and (ii) determines for the ELDs of each basis color a required driving voltage or electrical current in a corresponding driver for the ELDs of the pixel to display the specified color, each required driving voltage or electrical current being determined from corresponding values of driving voltages or electrical currents associated with predetermined colors within the gamut and a predetermined dynamic range in luminous intensity, subject to constraints on one or more physical characteristics of the ELDs, the constraints limiting, at different times, different groups of the physical characteristics, wherein the physical characteristics of the ELDs relate to (i) thermal dissipation in the ELD drivers; (ii) luminous intensity dynamic range shaping; (iii) smoothness in electrical responses due to control vector transitions; and (iv) output ranges of driver circuits.

2. The display system of claim 1, wherein the ELDs comprise more than three basis colors such that, for each pixel, more than one set of required driving voltages or electrical currents displays the color for the pixel, and wherein the control circuit selects the set of required driving voltages or electrical currents based on a predetermined consideration.

3. The display system of claim 1, wherein the control circuit uses values of driving voltages or electrical currents that are determined off-line.

4. The display system of claim 1, wherein one of the constraints limits the variation in maximum available luminous intensity.

5. The display system of claim 4, wherein that one of the constraints scale the allowable maximum luminous intensity by a factor between 0.0 and 1.0.

6. The display system of claim 1, further comprising interpolating between the values of driving voltages or electrical currents.

7. The display system of claim 1, wherein when the specified color is outside of the gamut, the control circuit maps the specified color to a substitute color within the gamut.

8. The display system of claim 7, wherein the substitute color lies along a line of approximate constant hue between achromatic point and a color on the spectral locus or the purple line.

9. The display system of claim 1, wherein the required driving voltage or electrical current is scaled from values of driving voltages or electrical currents that yield a predetermined luminous intensity of the specified color.

10. The display system of claim 1, wherein the predetermined colors within the spectral locus or the purple line are sampled in a uniform color space.

11. The display system of claim 1, wherein the predetermined colors are selected based on a predetermined spacing between adjacent ones of the predetermined colors.

12. The display system of claim 11, wherein the predetermined spacing is related to an Euclidean distance calculated in a uniform color space.

13. A method carried out in a display system, comprising:

providing a plurality of pixels in the display system each including a plurality of electroluminescent devices (ELDs) of three or more basis colors, the basis colors defining a gamut within the spectral locus and the purple line of human vision, wherein the ELDs of each basis color of each pixel, when driven by a voltage or an electrical current, emit light at a luminosity intensity that corresponds to the driving voltage or electrical current; and for each of the pixels, (i) receiving into a control circuit of the display system, a specification of a specified color to be displayed on the pixel; and (ii) for the ELDs of each basis color, determining in the control circuit a required driving voltage or electrical current in a corresponding driver for the ELDs of the pixel to display the specified color, the required driving voltage or electrical current being determined from corresponding values of driving voltages or electrical currents associated with predetermined colors within the gamut and a predetermined dynamic range in luminous intensity, subject to constraints on one or more physical characteristics of the ELDs, the constraints limiting, at different times, different groups of the physical characteristics, wherein the physical characteristics of the ELDs relate to (i) thermal dissipation in the ELD drivers; (ii) luminous intensity dynamic range shaping; (iii) smoothness in electrical responses due to control vector transitions; and (iv) output ranges of driver circuits.

14. The method of claim 13, wherein the ELDs comprise more than three basis colors such that, for each pixel, more than one set of required driving voltages or electrical currents displays the specified color for the pixel, the method further comprising selecting in the control circuit the set of required driving voltages or electrical currents based on a predetermined consideration.

15. The method of claim 13, wherein the values of driving voltages or electrical currents that are determined off-line.

16. The method of claim 13, wherein one of the constraints limits the variation in maximum available luminous intensity.

17. The method of claim 16, wherein that one of the constraints scale the allowable maximum luminous intensity by a factor between 0.0 and 1.0.

18. The method of claim 13, further comprising interpolating between the values of driving voltages or electrical currents are carried out.

19. The method of claim 9, wherein when the specified color is outside of the gamut, the method further comprises mapping the specified color to a substitute color within the gamut.

20. The method of claim 19, wherein the substitute color lies along a line of approximate constant hue between achromatic point and a color on the spectral locus or the purple line.

21. The method of claim 13, wherein the required driving voltage or electrical current is scaled from values of driving voltages or electrical currents that yield a predetermined luminous intensity of the specified color.

22. The method of claim 13, wherein the predetermined colors within the spectral locus or the purple line are sampled in a uniform color space.

23. The method of claim 13, wherein the predetermined colors are selected based on a predetermined spacing between adjacent ones of the predetermined colors.

24. The method of claim 19, wherein the predetermined spacing is related to an Euclidean distance calculated in a uniform color space.

* * * * *